US005746432A

United States Patent [19]

Feola

[11] Patent Number: 5,746,432

[45] Date of Patent: May 5, 1998

[54] METHOD OF PLAYING A GAME USING PLURALITY OF RANDOM VALUE SELECTORS

[76] Inventor: John Feola, 42 Irving St., Medford, Mass. 02155

[21] Appl. No.: 728,919

[22] Filed: Oct. 11, 1996

Related U.S. Application Data

[63] Continuation of Ser. No. 425,424, Apr. 20, 1995, abandoned.

[51] Int. Cl.[6] ..... A63F 1/00

[52] U.S. Cl. ..... 273/274; 273/142 R; 273/292

[58] Field of Search ..... 273/274, 249, 273/256, 309, 292, 142 R

[56] References Cited

U.S. PATENT DOCUMENTS

| | | | |
|---|---|---|---|
| 4,640,513 | 2/1987 | Montijo | 273/249 |
| 4,643,431 | 2/1987 | Hilinsky | 273/243 |
| 4,930,789 | 6/1990 | Harris et al. | 273/256 |
| 5,257,810 | 11/1993 | Schorr et al. | 273/292 |

FOREIGN PATENT DOCUMENTS

| | | | |
|---|---|---|---|
| 1555277 | 11/1979 | United Kingdom | 273/256 |

*Primary Examiner*—Benjamin H. Layno
*Attorney, Agent, or Firm*—Galgano & Burke

[57] ABSTRACT

Games which use a plurality of distinct random value selectors for generating values. The relationship of the independently generated values is considered to determine whether one of a predetermined plurality of possible winning outcomes has occurred. According to one embodiment of the invention, a game is started by spinning a wheel having a plurality of indicia thereon. The indicia obtained from spinning the wheel establishes a first value. At least one, and preferably a plurality of cards, are then displayed and their values added. Cards are displayed until the cumulative value of the cards exceeds the first value obtained by the wheel. If the cards attain a value greater than the value obtained from the wheel without exceeding a predetermined value, for example, twenty-one (21), then the cards are determined to be winning. Otherwise, the wheel is considered to be winning. Players are also advantageously provided with a plurality of other wagering options. According to another embodiment of the present invention, a first value is obtained by spinning a rotatable wheel and then a second value is obtained by rolling dice.

15 Claims, 4 Drawing Sheets

METHOD OF PLAYING A GAME USING PLURALITY OF RANDOM VALUE SELECTORS

This is a continuation of application Ser. No. 08/425,424, filed on Apr. 20, 1995, now abandoned.

The present invention is directed to games and, more particularly, to games which utilize a plurality of random value selectors for determining a successful outcome.

BACKGROUND OF THE INVENTION

People enjoy playing games in their leisure time. Some people particularly enjoy games which permit the option of wagering. Wagering often requires some combination of chance and/or skill. Card games, in particular, have been enjoyed for many years.

Various games have been described wherein a wheel, such as a rotatable wheel, dice, or cards are utilized to obtain a value which is utilized in determining a winning outcome.

While various games previously disclosed have used different forms of random value selectors, it has not previously been suggested to provide a winning outcome which is dependent upon values obtained from two, distinct random value selectors.

It would therefore be desirable to provide a game with increased excitement wherein at least one player is provided with an opportunity to wager on at least one possible outcome which is dependent upon values obtained from two, distinct, random value selectors.

SUMMARY OF THE INVENTION

One preferred embodiment of the present invention uses a plurality of distinct random value selectors for generating values which are utilized according to present parameters to determine possible winning outcomes.

According to one preferred embodiment of the present invention, a game is started by spinning a wheel having a plurality of indicia thereon. The indicia obtained from spinning the wheel establishes a first value. At least one, and preferably a plurality of cards, are then displayed. If the first value is not a predetermined maximum value, cards are dealt until the cumulative value of the cards exceeds the first value obtained by the wheel. In this case, if the cards attain a value greater than the first value obtained from the wheel without exceeding a predetermined value, for example, twenty-one (21), then the cards are determined to be winning. Otherwise, the wheel is considered to be winning. On the other hand, if the first value is equal to a predetermined maximum value, cards are dealt until the cumulative value of the cards is equal to or greater than the predetermined maximum value. If the cumulative value of the cards is equal to the predetermined maximum value, then the wheel value and the card value are considered to be tied, and additional steps are taken to determine a winner. If the card value exceeds the predetermined maximum value, then the wheel value is determined to be the winner. In addition to being able to wager on the wheel or cards, players are advantageously provided with a plurality of wagering options. According to this embodiment, after the cards are dealt, the winning payouts are paid.

According to another embodiment of the present invention, a first value is obtained by spinning a rotatable wheel and then a second value is obtained by rolling dice.

It will be understood that the various embodiments of the present invention utilize at least two distinct random value selectors to obtain separate values. Both values are used in determining whether a winning outcome has been obtained. Preferred embodiments require that the second random value selector obtain a value greater than the value obtained with the first random value selector and not greater than some other preselected value in order to be determined a winning value.

DETAILED DESCRIPTION

The present invention provides a game wherein a plurality of distinct random value selectors are utilized to obtain separate values which are both considered, e.g. compared. Players are provided with at least one and preferably a plurality of possible outcomes upon which to wager. The outcome is dependent upon the values obtained from the random value selectors.

Figure 1:
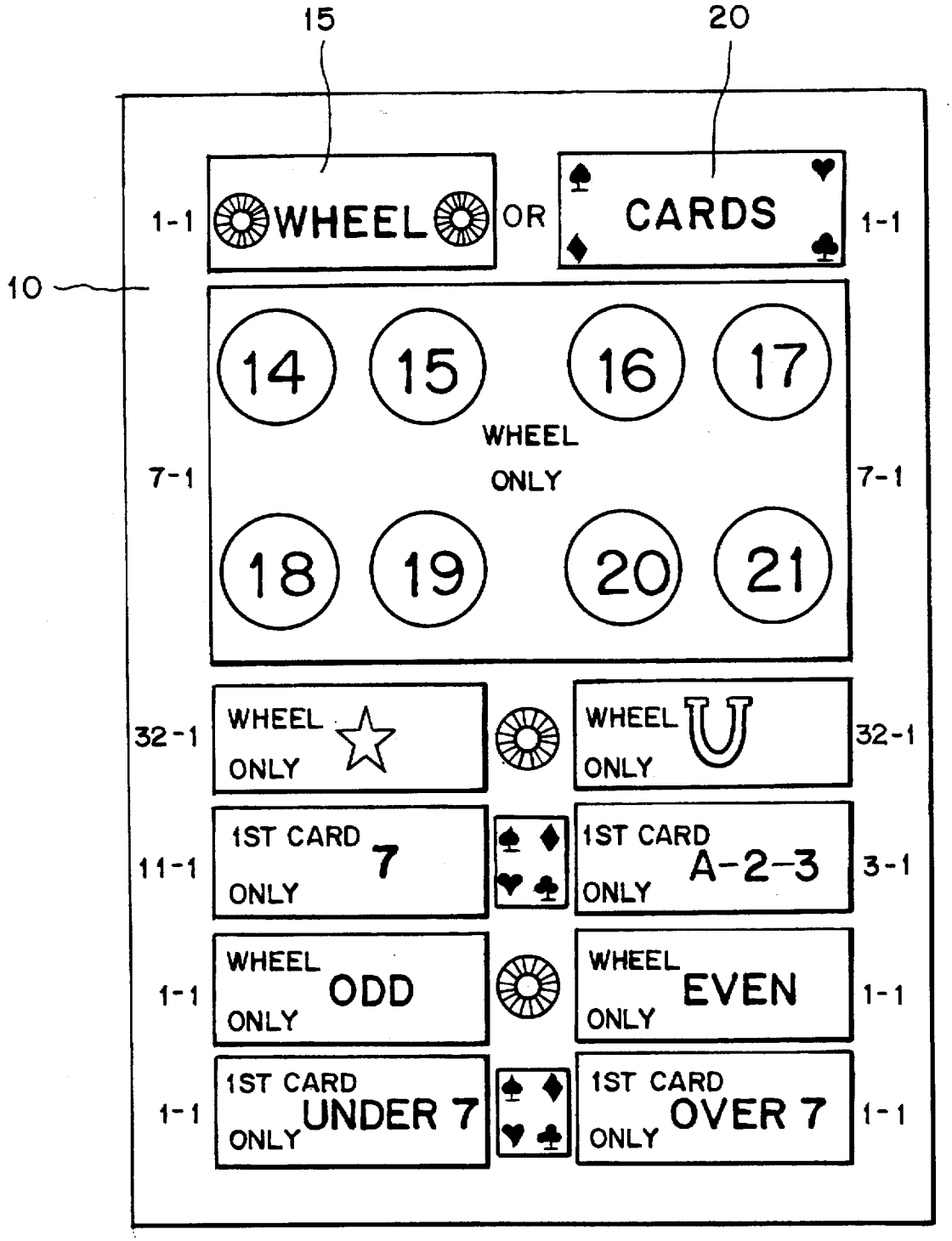
FIG. 1 illustrates one board game embodiment of the present invention having a plurality of wagering options.
Figure 2:
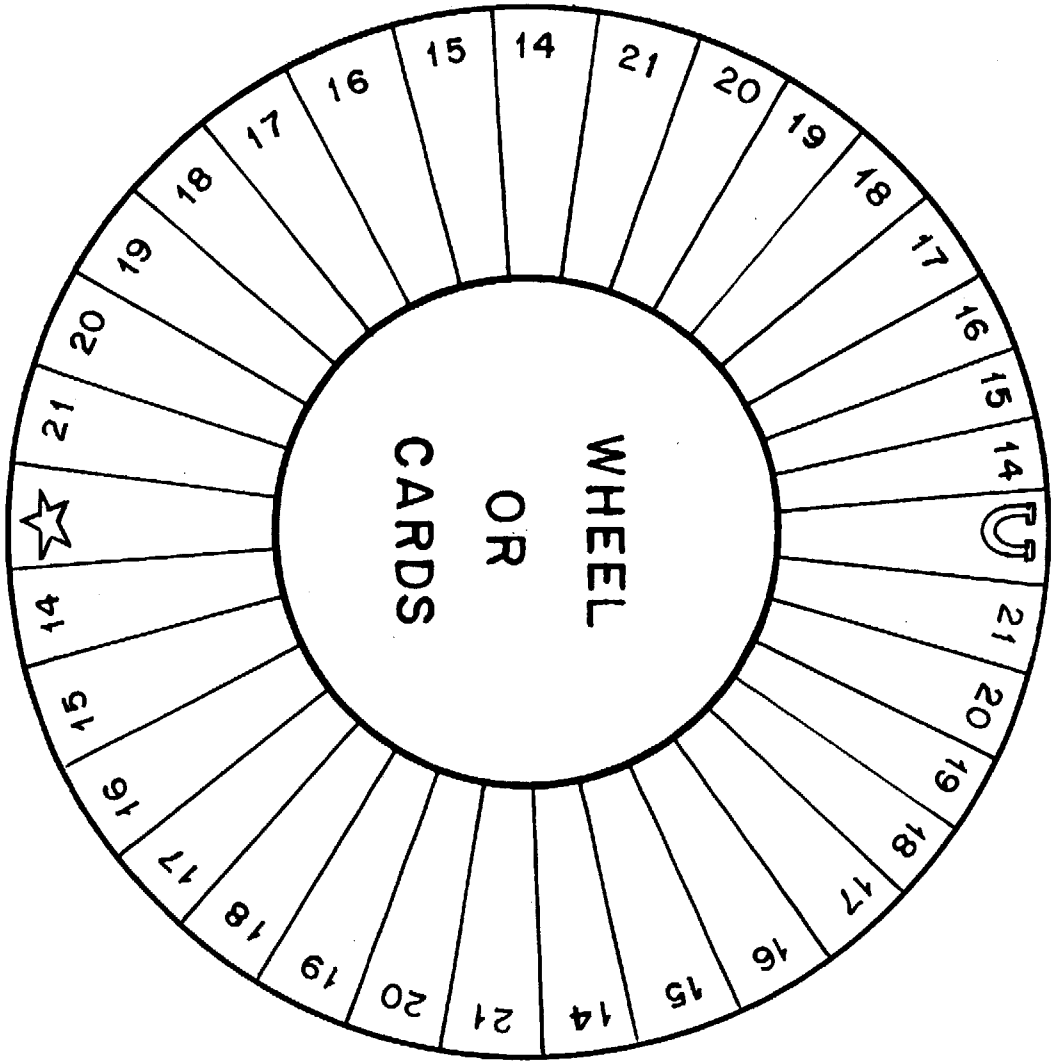
FIG. 2 illustrates a rotatable wheel which may be used with the first embodiment of the present invention.

According to the embodiment illustrated in FIGS. 1 and 2, players are provided with the option of placing wagers on a wagering board 10. The wagering area 10 illustrated in FIG. 1 can be spread over an entire large gaming table, but is most preferably a single player's wagering station on a gaming table. Therefore, according to a preferred layout of the present invention, each player has her own wagering area in the form shown in FIG. 1. This wagering layout provides players with the option of wagering on the success of the WHEEL or the CARDS. Additionally, players are provided with the option of wagering on specific values obtained with either the cards or the wheel. For example, with respect to the wheel, a player is given an option to wager on a specific number from fourteen (14) to twenty-one (21) as well as a. star or a horseshoe. Additionally, a player may wager on whether the wheel will land on an even or an odd number. The optional card wagers include whether the first card will be a seven (7), any one of an Ace, two (2) or three (3). Additionally, a player may wager on whether the first card will be over or under seven (7).

According to the preferred manner of playing this illustrated embodiment of the present invention, play is started by spinning the wheel. If the wheel lands on either the star or horseshoe, wagers on the selected symbol are paid. At this point, all other wagers on wheel bets and/or card bets may be collected and a new game started. Alternatively, the game may simply continue by respinning the wheel.

After a value of FOURTEEN (14) to TWENTY-ONE (21) has been selected by the wheel, a plurality of playing cards are displayed to the players. According to one preferred embodiment of the present invention, additional cards are displayed to the player until the sum of the card values exceeds the value indicated by the wheel without going over a predetermined value, e.g. twenty-one (21). If the cards tie the wheel at twenty-one (21), a "push" occurs. Pushes are only allowed when the cards tie the wheel at twenty-one (21). When this occurs, one additional card is displayed. Certain values will break the tie in the favor of the players while other values will break the tie in favor of the gaming establishment. For example, if the tie breaker card is a TEN (10) through a King, all wheel and card bets may be paid to the players. If the tie breaker card is under a TEN (10), then the establishment collects both the wheel and card wagers. All other wagers remain valid and are paid according to whether they occurred.

While the illustrated embodiment is designed for play with a standard deck of playing cards, other indicia may be utilized without departing from the scope of the present invention. With standard playing cards, Jacks, Queens and Kings have a point value of ten (10), whereas Aces have a value determined before play begins. For example, those skilled in the art will appreciate that Aces may typically have values of ONE (1) or ELEVEN (11). In order to properly determine the odds for winning payouts, it may be desirable to provide Aces with a set value of one (1) at all times.

From the present description, it will be understood that wagers placed in the "wheel" wagering area 15 are paid when the wheel achieves a higher valid value than the cards. For example, if the cards have a lower value or if the sum of the values of all cards displayed exceeds twenty-one (21), then the WHEEL wager is considered winning. The CARDS wager area 20 provides a payout when a valid card value exceeds the value obtained from the wheel. The remaining wagers are for illustration purposes and can be varied without departing from the scope of the present invention. The remaining wagers are not dependent upon the relationship of the values obtained from the distinct value selectors but are dependent upon values obtained with the occurrences of either the wheel or the cards. For example, the wagers from FOURTEEN (14) to TWENTY-ONE (21), the ODD and EVEN wagers, as well as the STAR and HORSESHOE depend entirely upon the outcome obtained from the wheel. On the other hand, the over SEVEN (7), under SEVEN (7), SEVEN (7) or Ace-TWO-THREE depend strictly upon the first card displayed. It will also be appreciated that the winning payouts are provided for purposes of illustration and may be varied without departing from the scope of the present invention.

Figure 3:
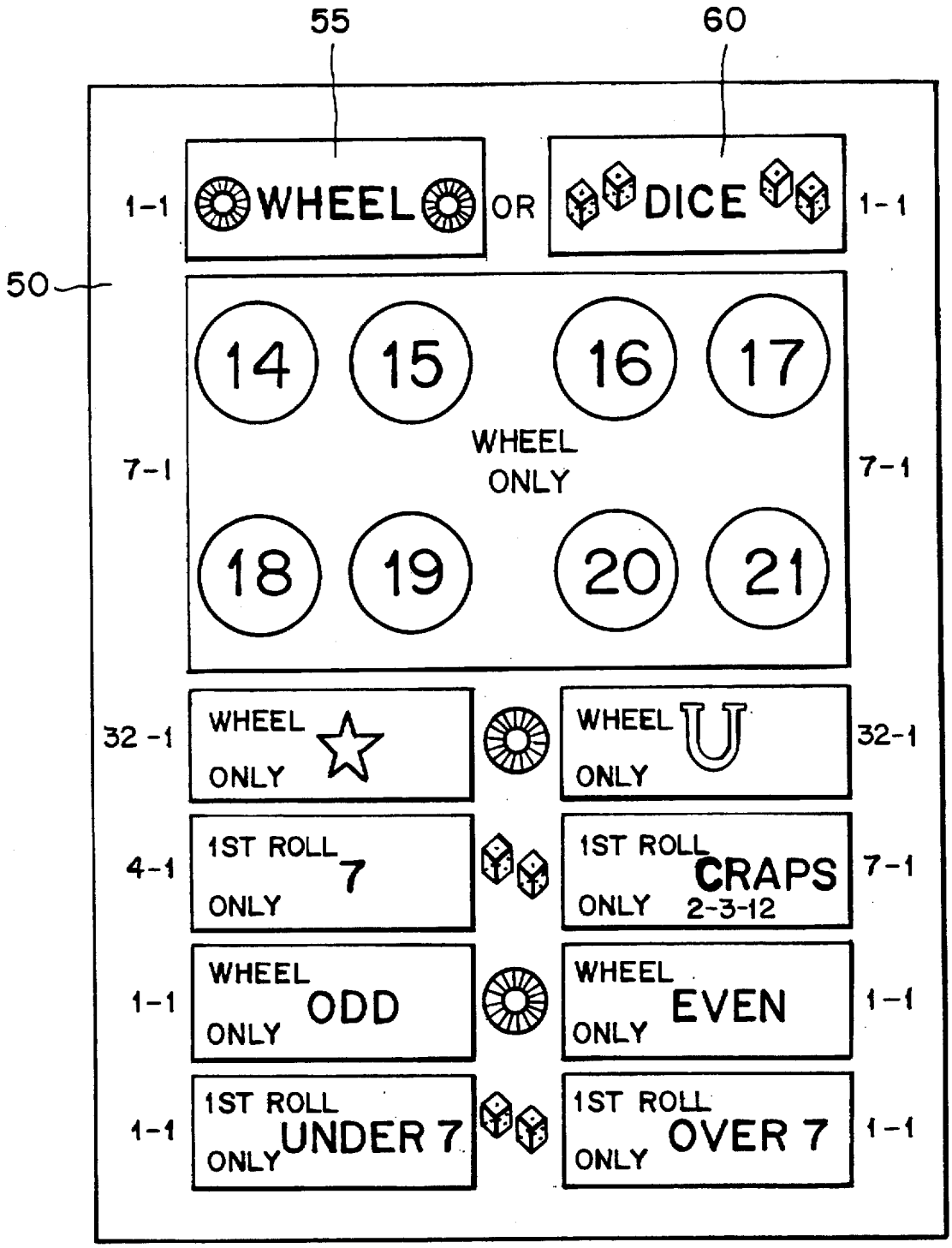
FIG. 3 illustrates a game board of a second embodiment of the present invention.
Figure 4:
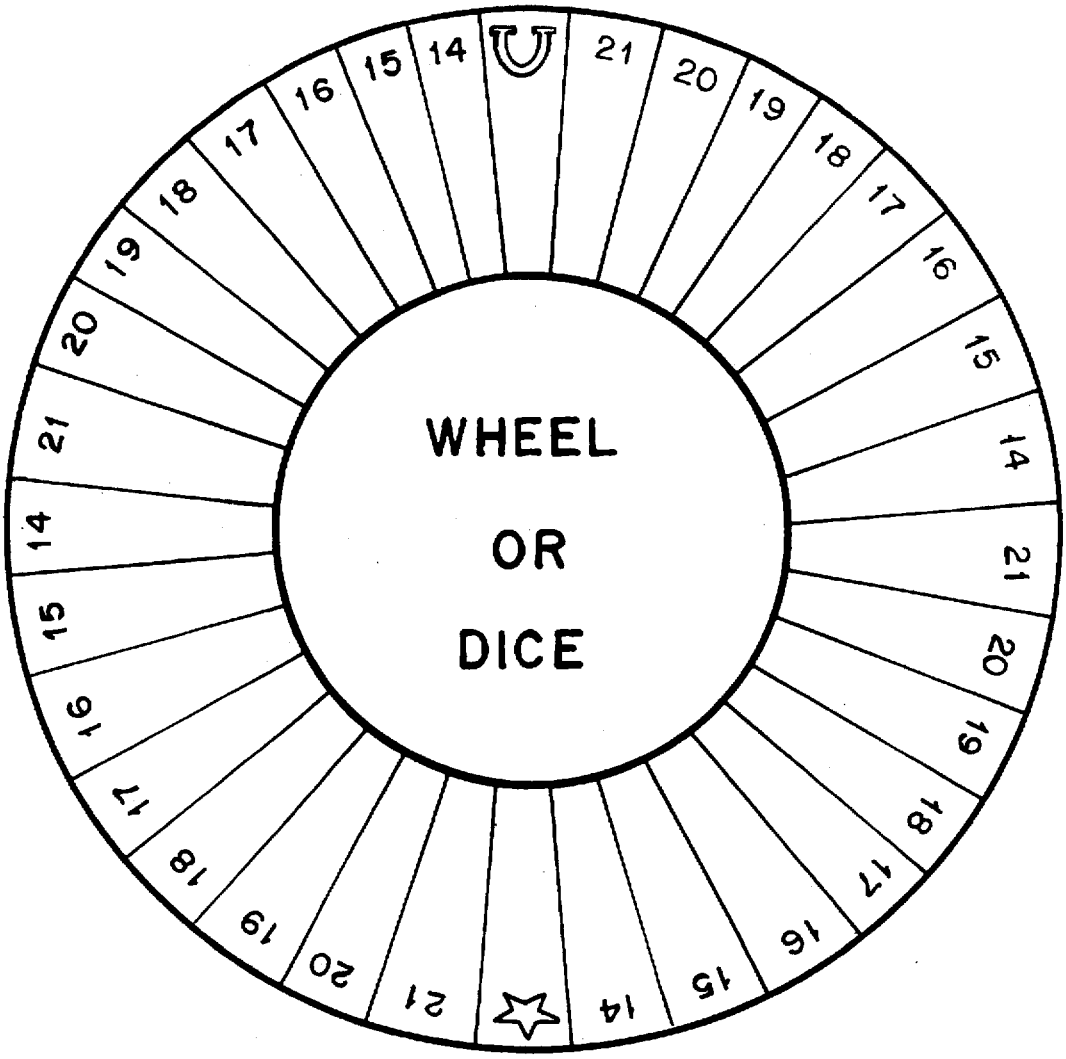
FIG. 4 illustrates a wheel which may be utilized with the second embodiment of the present invention.

According to an alternative embodiment of the present invention illustrated in FIGS. 3 and 4, a similar game is provided. According to this embodiment of the present invention, a wheel is used for obtaining a first value of FOURTEEN (14) to TWENTY-ONE (21) and then a pair of dice are utilized for obtaining the second value. In many respects, this embodiment is similar to the embodiment described above with reference to FIGS. 1 and 2. In addition to providing players with the option of placing a wager in wheel wager area 55 or dice wager area 60, players can wager on specific outcomes from the wheel or dice. Wheel bets include any specific numbers from FOURTEEN (14) to TWENTY-ONE (21), a STAR bet, a HORSESHOE bet, and odd and even bets. The dice bets include obtaining the following with the first roll of two dice, UNDER SEVEN, OVER SEVEN, SEVEN EXACTLY or CRAPS, i.e. TWO (2), THREE (3) or TWELVE (12).

According to this embodiment, the wheel is spun to start the game. Once a value of FOURTEEN (14) to TWENTY-ONE (21) is obtained, a pair of dice is rolled. The dice are preferably from a standard set of dice and may be rolled by one of the wagerers, preferably on a rotating basis. The dice may be rolled in any manner desired including by hand, cup or using a Chuck-A-Luck. Alternatively, the dealer may roll the dice. The party rolling the dice rolls until a cumulative value exceeding that of the wheel, without going over some predetermined value, e.g. twenty-one (21) in this case, is obtained. If the dice ties the wheel at some predetermined value or values, such as twenty (20) or twenty-one (21), a "push" occurs. All other wagers are deemed valid. As in the embodiment described above, a tie breaker may be provided. For example, a single roll of the dice may be utilized to break a tie according to some predetermined arrangement. For example, players on either WHEEL or DICE wagers may win the tie if the dice value is either a six (6), seven (7) or an eight (8). Any other value results in the gaming establishment collecting all wheel and dice wagers.

As in the embodiment illustrated above, the wagering board 50 in FIG. 3 provides options for wagers other than the success of the WHEEL or DICE wager areas. In the manner illustrated, players may be provided with options to wager on the outcome of either the wheel or the dice wherein the outcome is not dependent upon the relationship of the values obtained by the two distinct value selectors.

From the present description, it will be appreciated that the present invention provides games wherein players are provided with the option of wagering on one or more outcomes which are dependent upon the values obtained from two distinct random value selectors. While the illustrated embodiments utilize a wheel and cards, and a wheel and dice, respectively, it is also within the scope of the present invention to use dice and cards or other random value selectors, such as a roulette wheel, without departing from the scope of the present invention.

What is claimed is:

1. A method of playing a game comprising the steps of:

providing a predetermined maximum value;

providing at least one player with an opportunity to make at least one wager on the occurrence of one or more of a plurality of possible outcomes wherein at least some of said possible outcomes are dependent on values obtained from two distinct, random value selectors;

randomly selecting a first value from a plurality of possible values ranging up to said predetermined maximum value, wherein said first random value is never greater than said predetermined maximum value using a first random value selector;

subsequently obtaining a second value, from a plurality of possible values using a second random value selector which is different in form from said first random value selector, comparing said first random value with said second random value to determine each successful wager, and when said first random value is compared to said second random value, requiring said second random value to be never less than said first random value; and providing a winning payout to each successful wagerer.

2. A method of playing a game according to claim 1 wherein a player is given the opportunity to wager on which of said values will be higher.

3. A method of playing a game according to claim 2 wherein said second value is disqualified if said second value exceeds said predetermined maximum value.

4. A method of playing a game according to claim 3 wherein said predetermined maximum value is 21.

5. A method of playing a game according to claim 1 wherein a player is given the opportunity to wager on the occurrence of a particular value from said first random value selector.

6. A method of playing a game according to claim 1 wherein a player is given the opportunity to wager on the occurrence of a particular value from said second random value selector.

7. A method of playing a game according to claim 1 wherein one of said random value selectors comprises at least one die.

8. A method of playing a game according to claim 1 wherein one of said random value selectors comprises playing cards.

9. A method of playing a game according to claim 1 wherein one of said random value selectors comprises a rotatable wheel.

10. A method of playing a game according to claim 1 wherein said first random value selector is a wheel and said second random value selector comprises cards.

11. A method of playing a game according to claim 10 wherein said cards are deemed to win if the cumulative value of cards displayed is greater than said first value and not greater than said predetermined maximum value.

12. A method of playing a game according to claim 11 wherein said predetermined maximum value is 21.

13. A method of playing a game according to claim 1 wherein said first random value selector is a wheel and said second random value selector comprises at least one die.

14. A method of playing a game according to claim 13 wherein said dice are deemed to win if the cumulative value of dice displayed is greater than said first value and not greater than said predetermined maximum value.

15. A method of playing a game according to claim 14 wherein said predetermined value is 21.

* * * * *